US008919820B2

(12) United States Patent
Heim et al.

(10) Patent No.: US 8,919,820 B2
(45) Date of Patent: Dec. 30, 2014

(54) SECURITY ELEMENT AND METHOD FOR PRODUCING THE SAME

(75) Inventors: Manfred Heim, Munich (DE); Christian Schmitz, Schliersee-Neuhaus (DE)

(73) Assignee: Giesecke & Devrient GmbH, Munich (DE)

( * ) Notice: Subject to any disclaimer, the term of this patent is extended or adjusted under 35 U.S.C. 154(b) by 1399 days.

(21) Appl. No.: 10/512,406

(22) PCT Filed: Apr. 23, 2003

(86) PCT No.: PCT/EP03/04221

§ 371 (c)(1), (2), (4) Date: May 10, 2005

(87) PCT Pub. No.: WO03/091042

PCT Pub. Date: Nov. 6, 2003

(65) Prior Publication Data

US 2006/0249042 A1 Nov. 9, 2006

(30) Foreign Application Priority Data

Apr. 26, 2002 (DE) ..... 102 18 897

(51) Int. Cl.
*B42D 15/00* (2006.01)

(52) U.S. Cl.
CPC ..... *B42D 15/0026* (2013.01); *B42D 15/0013* (2013.01); *B42D 2033/10* (2013.01)
USPC ..... 283/72; 283/91; 283/94; 428/213

(58) Field of Classification Search
USPC ..... 283/72, 84, 91, 94; 428/203, 209, 213, 428/215, 216
See application file for complete search history.

(56) References Cited

U.S. PATENT DOCUMENTS

| | | | | |
|---|---|---|---|---|
| 6,382,677 | B1 * | 5/2002 | Kaule et al. | 283/107 |
| 6,491,324 | B1 * | 12/2002 | Schmitz et al. | 283/82 |
| 2002/0030360 | A1 * | 3/2002 | Herrmann et al. | 283/72 |

FOREIGN PATENT DOCUMENTS

| | | | |
|---|---|---|---|
| EP | 0 037 507 | A | 10/1981 |
| EP | 0 330 733 | A | 9/1989 |
| EP | 0 374 763 | A | 6/1990 |
| WO | WO 99/13157 | A | 3/1999 |
| WO | WO 99/67093 | A | 12/1999 |
| WO | WO 02/18155 | A | 3/2002 |

OTHER PUBLICATIONS

Converting: What is the metal layer of metallized films really like? http://www.convertingmagazine.com/article/CA243305.html.*

* cited by examiner

*Primary Examiner* — Kyle Grabowski
(74) *Attorney, Agent, or Firm* — Rothwell, Figg, Ernst & Manbeck, P.C.

(57) ABSTRACT

The invention relates to a security element for security papers, bank notes, ID cards or the like, with a substrate, on which are disposed at least two metal layers, the metal layers having different optical densities.

35 Claims, 10 Drawing Sheets

SECURITY ELEMENT AND METHOD FOR PRODUCING THE SAME

CROSS-REFERENCE TO RELATED APPLICATION

This application is a National Phase of International Application Serial No. PCT/EP03/04221, filed Apr. 23, 2003.

FIELD OF THE INVENTION

The invention relates to a security element for security papers, bank notes, ID cards or the like, as well as a security paper and a document of value with such a security element. Furthermore, the invention relates to methods for producing the security element, or the security paper and the document of value with such a security element.

DESCRIPTION OF THE BACKGROUND ART

In EP 0 330 733 A1 a security thread is proposed, which can be checked both visually as well as by machine. For this purpose a transparent plastic film is metallically coated and this coating is provided with gaps in the form of characters or patterns. Furthermore, the security thread contains colouring and/or luminescent substances in the areas congruent to the gaps, by means of which under appropriate light conditions the characters or patterns differ in a color-contrasting fashion from the opaque metal coating. Preferably, an aluminum layer is used as metal layer. This security thread is embedded in security papers as a so called "window security thread", i.e. it is woven in the paper during the sheet formation of the security paper, so that in regular intervals it is freely accessible at the surface of the paper and fully embedded in the paper only in the intermediate areas.

This security thread already meets the requirements of a very high security standard. The continuous metallic coating enables an automatic check of the electrical conductivity, while the gaps serve as a visual authenticity feature, which in transmitted light is easily recognizable by the viewer. Furthermore, the thread has an additional feature not easily recognizable by the viewer, namely the luminescence in the area of the gaps, which also is automatically checkable. When glancing cursory at bank notes, which have such a security thread, however, primarily the metallic luster of the window areas catches the eye. This luster can be imitated by simply bonding aluminum foil elements. When checking in a cursory fashion solely in incident light, such forgeries could be considered to be authentic bank notes.

SUMMARY OF THE INVENTION

It is therefore the problem of the present invention to propose a security element as well as a security paper and a document of value, which, compared to prior art, has an enhanced forgery-proofness.

According to the invention the security element has a substrate, onto which at least two metal layers with different optical densities are disposed preferably one above the other and/or preferably on the same side of the substrate. At least the layer with a higher optical density preferably has gaps, i.e. that at least in a partial area of the substrate only the optically thinner layer of the at least two metal layers with different optical densities is present. In case the metal layers are disposed one above the other, the two metal layers adjoin each other in particular directly, i.e. no further layers lie between the metal layers. The optical impression rendered by such a security element can be imitated, if at all, only with great effort, in particular if different-coloured metal layers are applied in complicated patterns with exactly defined layer thicknesses, which possibly may also be intertwined with each other.

The metal layers have different optical densities, i.e. each layer shows a different transmission behaviour. The optically denser metal layer of the at least two metal layers, hereinafter referred to as metal layer A, shows a lower transmission, preferably a maximum transmission of 30%, especially preferred a maximum of 10%. The optically thinner metal layer of the at least two metal layers, hereinafter referred to as metal layer B, shows a higher transmission than layer A, preferably more than 10%, especially preferred 25 to 80%. Particularly attractive effects are the result, when the metal layer A has a maximum transmission of 10% and the metal layer B a minimum transmission of 50%.

The metal layer A due to its lower transmission is perceived opaque by the viewer, while the metal layer B shows semitransparent properties.

"Semitransparency" here means translucence, i.e. the layer shows a light transmission ratio of under 90%, preferably between 80% and 20%.

The functional correlation between transmission T and optical density OD is formulated as follows:

$$OD = \log_{T[\%]}^{100}$$

The transmission values are preferably determined within the visible spectral region, especially preferred at a wavelength of 500 nm.

Furthermore, the optical density of a metal layer depends, among other things, on the metal used and on the layer thickness. Depending on the kind of metal and on the transmission properties to be achieved, as a rough approximate value for metal layer A can be assumed a layer thickness of about 20 to 300 nm and for metal layer B a layer thickness of 2 to 20 nm.

The metal layers can be applied onto the substrate either side-by-side, overlapping or one above the other.

In principle, the layer order of the metal layers can be any desired order. The designations metal layer A and metal layer B do not represent the order with respect to a carrier, but shall merely permit an easier linguistic differentiation between a layer optically more dense and a layer optically less dense. For example, with layers lying one above the other at first the optically denser metal layer can be applied and then the optically thinner metal layer. However, the layer order can be vice versa as well. Which layer order is the more suitable one results from the individual case.

In the inventive embodiment the metal layers preferably are disposed one above the other. The metal layers disposed one above the other in particular adjoin each other directly, i.e. no further layer is disposed between the metal layers A and B.

The metal layers A and B can consist of the same material, but also of different materials. When combining different metals, the following color combinations are particularly suitable: gold-/silver-coloured, gold-/copper-coloured, chromium-/gold-coloured, chromium-/copper-coloured.

Suitable metals are, for example, aluminum, cobalt, copper, gold, iron, chromium, nickel, silver, platinum, palladium, titanium or other "nonferrous metals" and any alloys thereof such as e.g. Inconel, gold bronzes, silver bronzes etc. For the optically denser layer A preferably aluminum is used because of its small penetration depth for visible light and because it is easier to process, and gold, copper, chromium, silver or iron are used for the optically thinner layer B because of their large penetration depth for visible light and their characteristic colour.

Some preferred material combinations are summarized in the table shown below.

When viewing this security element in transmitted light, the areas not covered with the opaquely appearing layer A are clearly recognizable as transparent areas. Depending on how the transmission properties of the optically thin metal layer B have been adjusted, the viewer, despite the metal coating B present in the area of the gaps of layer A, believes to perceive fully transparent areas or semitransparent areas.

| | T < 10% layer A | | | | | | | | | |
|---|---|---|---|---|---|---|---|---|---|---|
| T > 50% layer B | Alu | Copper | Gold | Iron | Chromium | Nickel | Silver | Platinum | Palladium | Inconel |
| Alu | D/A | O | O | OM | O | M | | | | O |
| Copper | O | D/A | O | OM | O | M | O | O | O | O |
| Gold | O | O | D/A | OM | O | M | O | O | O | O |
| Iron | O | O | O | D/A | | M | O | O | O | |
| Chromium | O | O | O | D/A M | D/A | M | O | O | O | |
| Nickel | | O | O | OM | O | D/A | | | | O |
| Silver | | O | O | OM | O | | D/A | | | O |
| Platinum | | O | O | OM | O | | | D/A | | O |
| Palladium | | O | O | OM | O | | | | D/A | O |
| Inconel | O | O | O | M | | O | O | O | O | D/A |

T: transmission

O: visually easily perceptible colour contrast

M: with an appropriate thickness a machine-readable magnetism in layer A is the result D/A: when viewed in incident light the security element appears homogeneously metallized; in transmitted light gaps are visible.

The forgery-proofness can be additionally increased, when the gaps, i.e. the places, where the optically denser layer is not present or which are metal-free, do not have an only simple form, but the form of alphanumeric characters, patterns, logos or the like, or are disposed in the form of a code, e.g. a bar code.

The optically denser metal layer when having an appropriate thickness can additionally have magnetic properties. When the gaps are disposed in a suitable fashion, even a machine-readable coding can be incorporated into the security element.

The substrate of the security element preferably is a plastic film. In addition, the substrate can be provided with diffraction structures in the form of a relief structure. The diffraction structures can be any diffractive structures, such as holograms or grating structures (e.g. Kinegrams®, pixelgrams) or the like.

Furthermore, it is possible, that the substrate consists of films laminated together. In particular two films can be laminated together, one metal layer at a time being present on the outside of a film.

In the following are described the different variations of layer material and layer structure in combination with gaps and diffraction structures and their different forms of appearance. Of course, all variations can be combined with each other in any desired fashion.

Variation 1: Metal Layers Made of the Same Material

In this embodiment the metal layers A and B consist of the same material. For example, aluminum can be vapor-deposited onto the substrate as metal layer A and B. The different optical densities of the individual layers are achieved e.g. via a variation of the layer thickness.

The layer sequence in the security element reads, for example, substrate, optically thin metal layer B, optically dense metal layer A. Alternatively, the layer structure can read substrate, optically dense metal layer A, optically thin metal layer B. Preferably, all three layers lie directly one above the other and are not separated from each other by further layers. The optically dense metal layer A is not applied all-over, i.e. the opaquely appearing layer A has gaps.

In incident light the security element appears as uniform all-over-coated surface. I.e. the gaps are not visible.

Beside the gaps in the metal layer A, there can be gaps in the metal layer B, too. Impressive effects are achieved, whenever the layers A and B lie one above the other and a part of the gaps in the metal layers A and B at least partially lie one above the other and preferably are disposed congruently, or lie one above the other and preferably the gaps in the metal layer A are larger than the gaps in the semitransparent metal layer B.

The gaps in one or in the two metal layers can be disposed in any form, combination and order.

Additionally, the security element can be equipped with diffraction structures. Preferably, these are incorporated at least into partial areas of the substrate surface, preferably embossed, the metal layers coming to lie on the substrate surface with the diffraction structures. Preferably, the coating order will be the following: substrate with diffraction structure/metal layer A/metal layer B.

The diffraction structures are particularly brilliantly visible in those places, where a metal layer is present, i.e. where is no gap. In the area of the gaps in transmitted light the diffraction structures are only slightly visible or not visible. In incident light the diffraction structures are visible in both the area of the metal layer as well as the area of the gaps.

Variation 2: Metal Layers Made of Different Materials

With this embodiment the metal layers A and B consist of different materials. For example, aluminum can be vapor-deposited onto the substrate as metal layer A and gold as metal layer B. The different optical densities of the individual layers are achieved e.g. via a variation of the layer thickness and/or the material.

The layer sequence within the security element and the disposition of the gaps in the individual layers can be the same as described in variation 1.

When viewing this security element in transmitted light, the gaps in the layer A are clearly recognizable as transparent areas. Depending on how the transmission properties of the optically thin metal layer B have been adjusted, the viewer, despite the metal coating B present in the area of the gaps in layer A, believes to perceive fully transparent areas or semitransparent areas. Possibly, the semitransparent areas stand out in colour against the surroundings due to the different materials in layer A and B.

In incident light the security element does not appear as a uniform, all-over coated surface, but shows another appearance in the areas not covered with the optically denser metal, namely areas in the colour tone of the second metal. I.e. the gaps in the metal layer A are also visible in incident light and have the colour of the metal layer B.

Beside the gaps in the metal layer A, there can be gaps in the metal layer B, too. Impressive effects are achieved, whenever the layers A and B lie one above the other and a part of the gaps in the metal layers A and B at least partially lie one above the other and preferably are disposed congruently, or lie one above the other and preferably the gaps in the metal layer A are larger than the gaps in the semitransparent metal layer B.

The gaps in one or in the two metal layers can be disposed in any form, combination and order.

Additionally, the security element can be equipped with diffraction structures. Preferably, these are incorporated at least into partial areas of the substrate surface, preferably embossed, the metal layers coming to lie on the substrate surface with the diffraction structures. Preferably, the coating order will be the following: substrate with diffraction structures/metal layer A/metal layer B.

The diffraction structures are particularly brilliantly visible in those places, where a metal layer is present, i.e. where is no gap. In incident light the diffraction structures are recognizable also on the places of the gaps.

The following description is not restricted to the variations 1 and 2, but is to be understood as a general description which applies to all embodiments equally.

The security element can be a security thread, which consists of a self-supporting plastic film to which the different metal layers are applied. This security thread can at least partially be incorporated into a security paper or security document. If the security thread is designed such that it looks identically irrespective of whether viewing front or back, not even the trueness to side needs to be taken into account when incorporating the security thread. It is also thinkable to form the security element in a ribbon-shaped or label-shaped fashion and to fasten it to the surface of the security paper or document of value.

Alternatively, the security element can also have the form of a transfer element or laminated film. This variation is particularly advantageous, if the security element is disposed completely on the surface of the security paper or document of value. In this case the layer structure of the security element is prepared on a carrier foil, usually a plastic film, and afterwards transferred in the desired outline contours to the security paper or document of value e.g. by means of a hot stamping method.

If the security element is disposed on the surface of the security paper or document of value, it can have any outline structures, such as for example round, oval, star-shaped, rectangular, trapezoidal or strip-shaped outline contours.

According to a preferred embodiment the security paper or document of value, onto which the security element is applied, has a continuous opening. Here the security element is disposed in the area of the opening and protrudes it on all sides.

In another preferred embodiment the security paper or document of value has a security element in the form of a security thread.

In both embodiments the security element can be checked from both front and back of the paper or document, which distinctly facilitates the authentication check even for an unpractised viewer.

Therefore, an imitation of the colour effect is particularly complicated or can be completely ruled out with these embodiments.

But the use of the inventive security element is not restricted to the area of security documents. The inventive security element can also be advantageously used in the field of product protection for protecting any goods from forgery. For that purpose the security element can have additional antitheft elements, such as for example a coil or a chip. The same applies to the security paper or document of value that is provided with such a security element.

The application of the metal layers preferably is effected by a vapor deposition unit, e.g. by means of sputtering or by means of an electron beam vapor deposition method.

The manufacturing of the gaps in the respective metal layers preferably is effected with the aid of a washing method as described in WO 99/13157, which is incorporated herein by reference. Here the security elements are prepared in the form of a security foil, which contains a number of simultaneous copies of the security element. The basic material is a self-supporting, preferably transparent plastic film. This plastic film in the case of security threads or labels corresponds to the inventive plastic layer of the security element. When the security elements are dissolved out from an embossed film, the plastic film forms the carrier material of this transfer material, to which the plastic layer is applied in the form of a lacquer layer. In this lacquer layer or, in the case of security threads or labels, in the plastic film can be embossed diffraction structures. The inventive plastic layer of the security element is printed in the form of the future gaps, preferably by gravure printing. For this a printing ink with a high pigment content is used, which forms a pored, raised applied ink layer. Afterwards the different-coloured metal layers are vapor-deposited onto the printed plastic layer. As a last stage finally the applied ink layer and the metal layer lying on top of it are removed by washing out with a liquid, possibly combined with mechanical action. Preferably, a water-soluble printing ink is used, so that water can be used as liquid. Thus this method is very environmentally friendly and does not require any particular protective measures. Furthermore, this method has the advantage, that the gaps in the two or several metal layers are manufactured in one single operation.

The washing out can be supported by mechanical means, such as a rotating roll, brush or ultrasound.

As an alternative to the vapor-deposition of the layers onto one substrate, the layers each can be applied to a separate substrate. Afterwards, the coated substrates are laminated together, preferably in such a way, that the coated sides of the substrates come to lie facing each other.

Due to the fact, that the inventive security element cannot be imitated with simple technical means and every attempt of replication is easy to detect, but also due to the visually distinctly perceptible colour effects and incident/transmitted light effects which are easily recognizable by a viewer, the inventive security element shows an enormously improved forgery-proofness. In particular the security element cannot be manufactured by the mere punching out of foil, etching away or scraping off the metal layer, since the metallization technique and at the same time exact control of the layer thicknesses have to be mastered.

BRIEF DESCRIPTION OF THE DRAWINGS

Further embodiments and advantages of the inventive security element or security paper and document of value are explained with reference to the figures. The Figures are schematic diagrams and do not necessarily correspond to the dimensions and proportions present in reality.

DETAILED DESCRIPTION OF THE INVENTION

Figure 1:
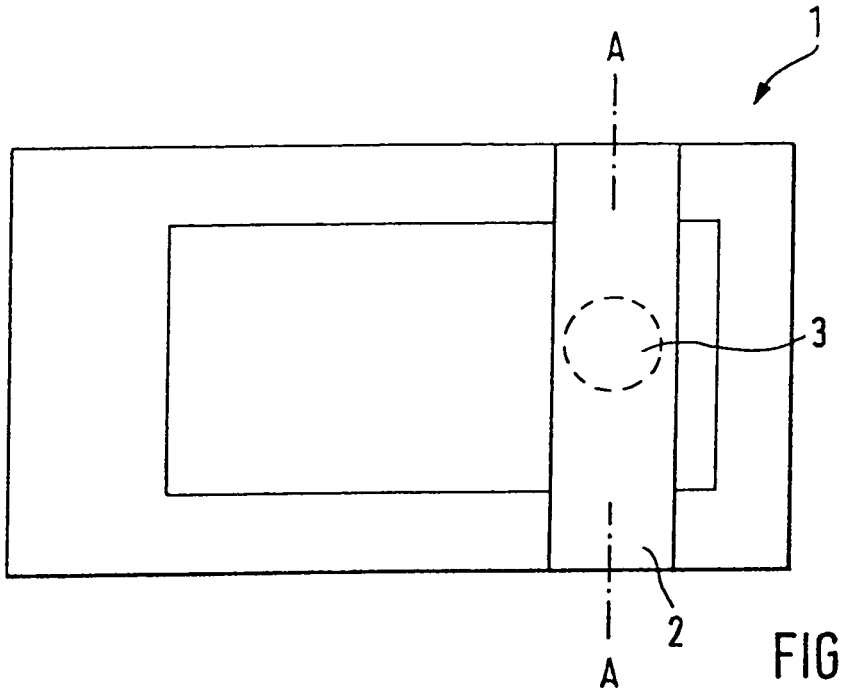
FIG. 1 shows an inventive document of value.

FIG. 1 shows an inventive document of value in a top view. The shown example is a bank note 1. This bank note has a strip-shaped security element 2, which extends across the entire width of the bank note 1 and spans a hole 3 in the bank note. The displayed security element is a security element that consists of a plastic layer and two metal layers of different optical densities. At least in the optically denser layer, optionally also in the optically thinner layer, are located the gaps. The entire surface of the security element 2 facing the viewer is coated according to the invention, the effects, in particular visually perceptible in the area of the hole 3, being described in the following Figures. For clarity's sake the following Figures each show a layer structure minimized to the basic inventive idea. Further layers, such as adhesive layers or laminated films used for protecting the surface etc., can of course be present additionally, and are to be added by the person skilled in the art depending on the case of application.

Figure 2A:
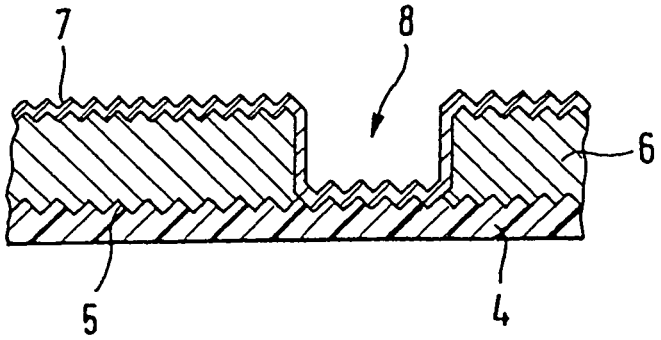
FIG. 2*a* shows layer structure and section through an inventive security element along the line A-A.

FIG. 2*a* in a detail view shows the cross section of the security element 2 along the line A-A in FIG. 1 in a first embodiment. Here the plastic film 4 can be recognized, which serves as a substrate for the metal layers to be vapor-deposited. In the plastic layer the diffraction structures 5 are incorporated. Alternatively, the diffraction structures could be incorporated in an additionally applied lacquer layer. To the side of the plastic film, where the diffraction structures are located, a metal layer 6 is vapor-deposited directly adjoining, which is the optically denser metal layer A and which appears opaque when viewed. In the present embodiment the metal layer A consists of aluminum. Thereabove again a metal layer 7 is located, namely the optically thinner metal layer B, which also consists of aluminum. In the layers 6 and 7 there are present the same diffraction structures as in plastic film 4. Additionally, in the layer 6 are located gaps 8, which are any characters, alphanumeric characters, patterns, logos or the like. The layer order substrate/layer A/layer B results in advantageously designed security elements, in particular when diffraction structures are contained in the substrate.

Figure 2B:
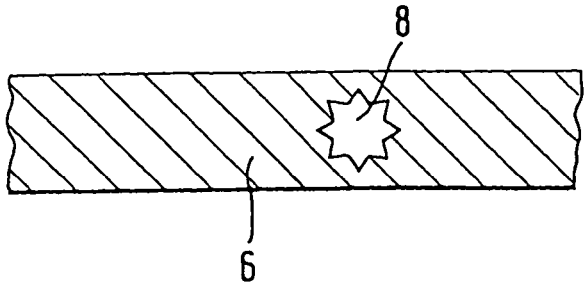
FIG. 2*b* shows the security element according to FIG. 2*a* in a top view in transmitted light.

FIG. 2*b* shows how the detail of FIG. 2*a* appears when viewed in transmitted light. When viewing the security element from the uncoated side of the substrate 4, in transmitted light the gap 8 is recognizable as a transparent area or as a semitransparent area. The gap 8, here in the form of a star, is all-over bordered by the silver appearing aluminum layer 6.

Figure 2C:
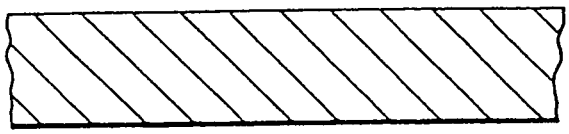
FIG. 2*c* shows the security element according to FIG. 2*a* in a top view in incident light.

FIG. 2*c* shows the same detail viewed in incident light. The gap 8 is no longer recognizable as such and the viewer is shown a seemingly all-over homogeneously coated security element.

Figure 3A:
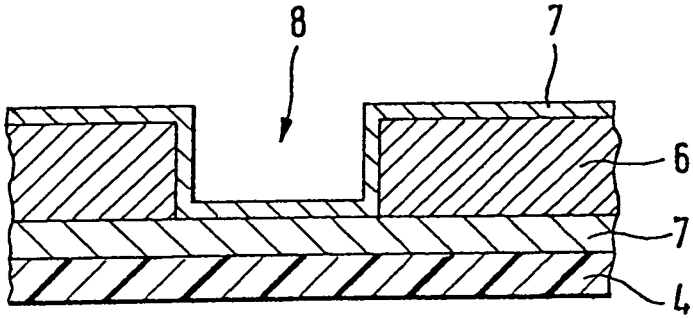
FIG. 3*a* shows layer structure and section through an inventive security element along the line A-A.

In FIG. 3*a* a further embodiment of an inventive security element is shown in cross section. Here the plastic film 4 at first is coated with an optically thinner aluminum layer 7, and thereabove is located an optically denser aluminum layer 6 with gaps 8. Onto the optically denser aluminum layer 6 a second optically thinner aluminum layer 7 is vapor-deposited. In the area of the gap 8 the two optically thinner aluminum layers 7 adjoin each other, the sum of the two layer thicknesses of the two aluminum layers 7 being lower than the layer thickness of the metal layer 6. The advantage of this embodiment is, that it is a symmetrical security element, i.e. irrespective of whether being viewed from front or back, the appearance is always the same.

Figure 3B:
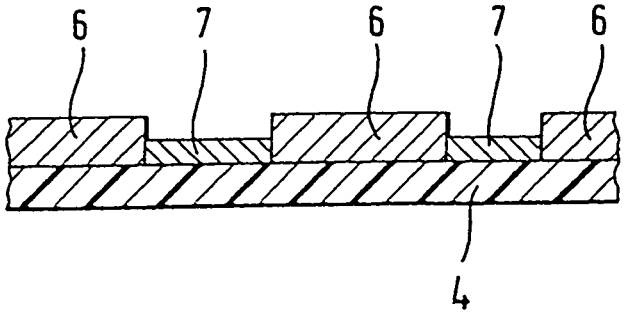
FIG. 3*b* shows layer structure and section through an inventive security element along the line A-A.

In FIG. 3*b* an embodiment of an inventive security element is shown in cross section, in which the optically denser layer 6 and the optically thinner layer 7 are not placed one above the other, but next to each other. At first a plastic film 4 is only partially coated with an optically thinner aluminum layer 7, e.g. in a strip-shaped fashion. In a second stage the optically denser aluminum layer 6 is applied to the spaces in between in exact register or slightly overlapping with layer 7. This embodiment, too, shows the same appearance irrespective of whether viewed from front or back. In transmitted light on the ribbon-shaped substrate the viewer sees alternating light and dark stripes extending crosswise thereto. In incident light the substrate appears uniformly silvery-coated.

Figure 4A:
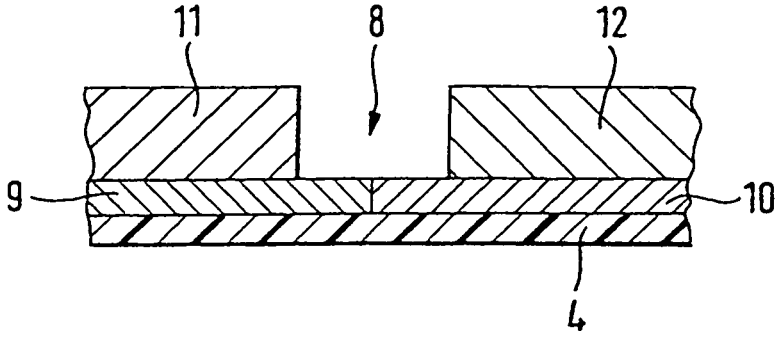
FIG. 4*a* shows layer structure and section through an inventive security element along the line A-A.

FIG. 4*a* shows a further embodiment in cross section. With this variation at first the optically thinner layer B and afterwards the optically denser layer A is applied onto the substrate 4, in contrast to the layer order in FIG. 2*a*. This layer order is preferably used for substrates not embossed. This embodiment is characterized by the fact, that the optically thinner layer and the optically denser layer are each composed of different metals. With respect to this no restraints are imposed upon a person skilled in the art. By way of example one possibility, representative for many others, is described with reference to FIG. 4*a*. On the substrate 4 in the left area of the Figure is located the optically thinner metal layer 9 made of aluminum and in the right area of the Figure is located the optically thinner metal layer 10 made of chromium. On top of the metal layer 9 made of aluminum is located a further aluminum layer 11, though designed as an optically denser layer. On top of the chromium coating is located the optically denser metal layer 12 made of gold. The optically denser layers made of aluminum and gold here are disposed in such a way, that a gap 8 is the result in the area where the optically thinner layers 9 and 10 adjoin each other.

Figure 4B:
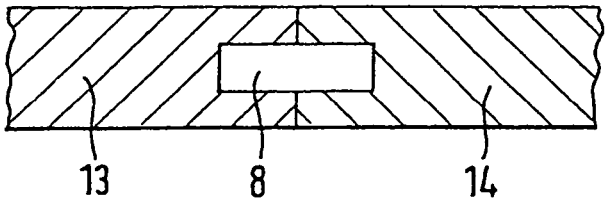
FIG. 4*b* shows the security element according to FIG. 4*a* in a top view in transmitted light.

FIG. 4*b* shows the detail of the security element shown in FIG. 4*a* in cross section when viewed in transmitted light. When viewing the security element from the direction of the optically denser layer, in the left area of the image can be seen the silvery appearing area 13 and in the right area the gold-coloured appearing area 14. The gap 8 can be recognized as a transparent detail protruding into the area 11 as well as into the area 12.

Figure 4C:
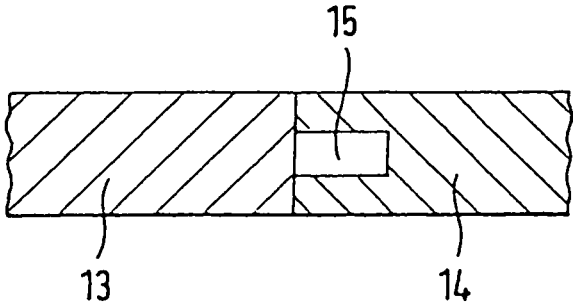
FIG. 4*c* shows the security element according to FIG. 4*a* in a top view in incident light.

FIG. 4*c* shows the same detail in incident light. In the left area of the figure the security element appears as all-over homogeneously silver-shining surface 13, while in the right area of the FIG. 14 a silver-coloured partial area 15 is visible, which is for the most part surrounded by the gold-coloured area 14.

Figure 5A:
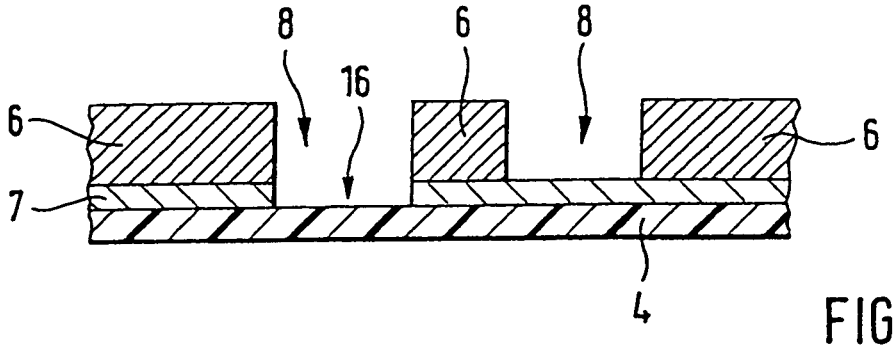
FIG. 5*a* shows layer structure and section through an inventive security element along the line A-A.

FIG. 5*a* shows a further embodiment of the inventive security element 2. In this variation both the optically thinner as well as the optically denser metal layer are made of aluminum. Onto the substrate 4 at first the optically thinner aluminum layer 7 is applied, this layer already having a gap 16. Onto the optically thinner aluminum layer 7 the optically denser aluminum layer 6 is applied in such a way, that the gaps in the optically denser layer 8 on the one hand come to lie congruently to the gap 16 and on the other hand are located above the optically thinner layer 7.

Figure 5B:
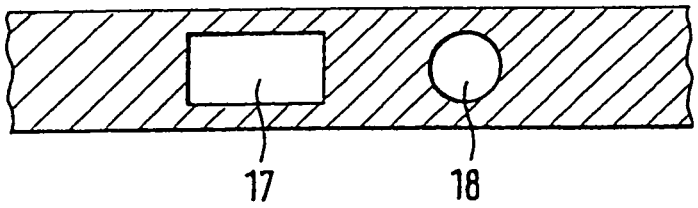
FIG. 5*b* shows the security element according to FIG. 5*a* in a top view in transmitted light.

When viewing the security element of FIG. 5*a* in transmitted light, to the viewer appears, as shown in FIG. 5*b*, a silver-shining ribbon with transparent areas, which are designed on the one hand as a square 17 and on the other hand as a circle 18.

Figure 5C:
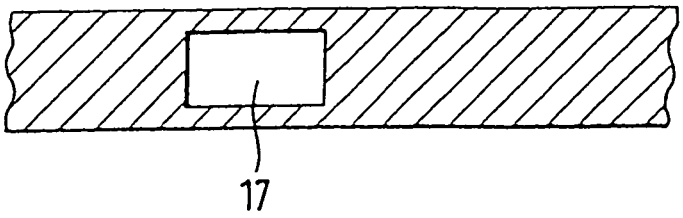
FIG. 5*c* shows the security element according to FIG. 5*a* in a top view in incident light.

As shown in FIG. 5*c*, in incident light a different image is presented to the viewer. Here the gap 16, which is congruent to gap 8, can still be perceived as transparent area 17, while the area 18 no longer is recognizable and the security element in this area presents itself as an apparently homogeneously coated element.

Figure 6A:
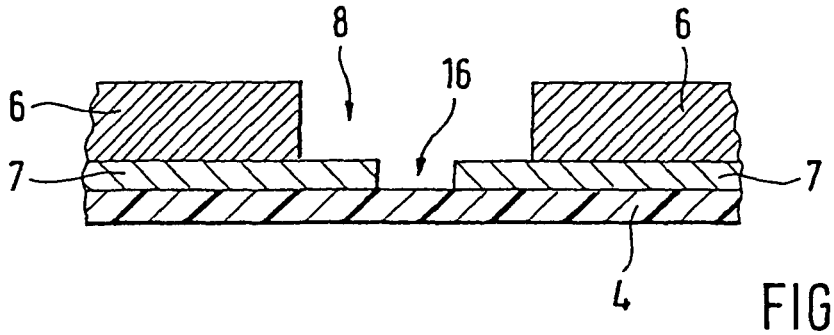
FIG. 6*a* shows layer structure and section through an inventive security element along the line A-A.
Figure 6B:
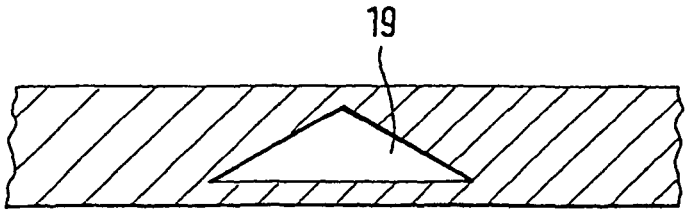
FIG. 6*b* shows the security element according to FIG. 6*a* in a top view in transmitted light.

FIG. 6*a* shows a further embodiment of the inventive security element. In this element, too, the optically thinner layer 7 and the optically denser layer 6 are made of the same material, namely aluminum. The gaps in both layers are disposed in such a way, that the gap 16 in the optically thinner layer and the gap 8 in the optically denser layer are disposed one on top of the other, the gap 8 being larger than the gap 16. The disposition of the layers on the substrate 4 corresponds to that shown in FIG. 5*a*. When viewing this security element in transmitted light, as shown in FIG. 6*b*, the viewer perceives a transparent area 19, which corresponds to the outline form of the gap 8. Gap 16 is not recognizable as such.

Figure 6C:
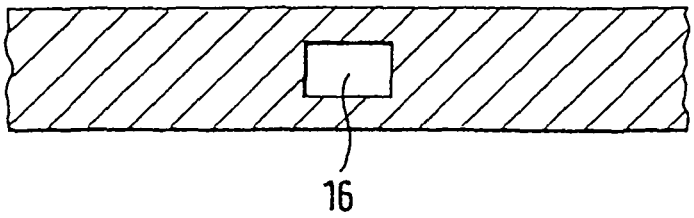
FIG. 6*c* shows the security element according to FIG. 6*a* in a top view in incident light.

When viewing this segment in incident light, as shown in FIG. 6*c*, only gap 16 can still be perceived as a transparent area. Again, gap 8 is perceived as a homogeneous surface, which cannot be differentiated from the rest of the opaque layer.

To what extent the optically thinner layer 7 is perceived as transparent or semitransparent, depends on the respective materials and layer thicknesses. These can be adjusted depending on the desired effect by a person skilled in the art.

Figure 7A:
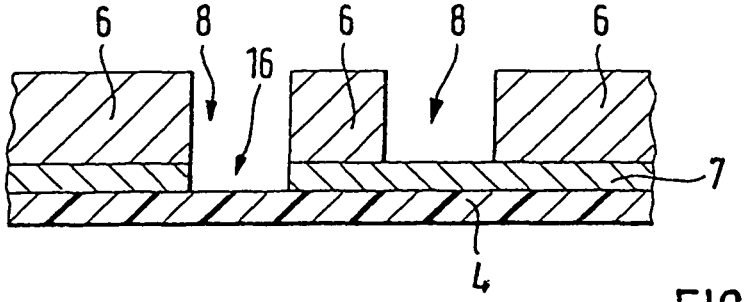
FIG. 7*a* shows layer structure and section through an inventive security element along the line A-A.
Figure 7B:
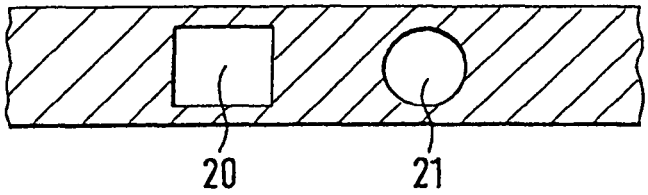
FIG. 7*b* shows the security element according to FIG. 7*a* in a top view in transmitted light.
Figure 7C:
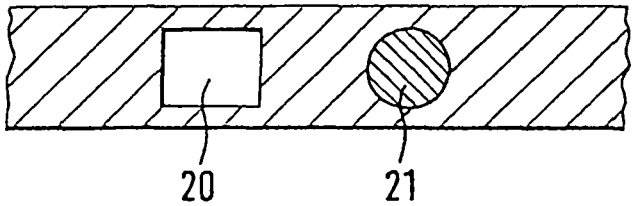
FIG. 7*c* shows the security element according to FIG. 7*a* in a top view in incident light.

FIG. 7*a* shows an embodiment, which shows the same layer structure as FIG. 5*a*, but differs from the embodiment of FIG. 5*a* in the fact that the optically thinner layer 7 is made of copper and the optically denser layer 6 is made of aluminum. In transmitted light, as shown in FIG. 7*b*, in the area of the gaps 8 and 16, again, transparent areas 20, 21 are recognizable. If desired, the transmission property of the copper layer can be adjusted in such a way, that the viewer does not perceive a fully transparent gap in the area 21, but recognizes a slightly greenish semitransparent area. In incident light, as shown in FIG. 7*c*, the gap 16 continues to be recognizable as a transparent area 20, while in the area of the gap 8, which lies on top of the copper layer, appears a circular-shaped, copper-coloured element 21 in silvery surroundings.

Figure 8A:
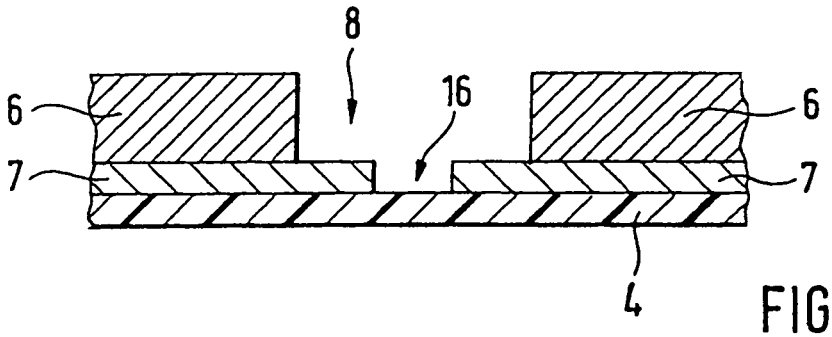
FIG. 8*a* shows layer structure and section through an inventive security element along the line A-A.
Figure 8B:
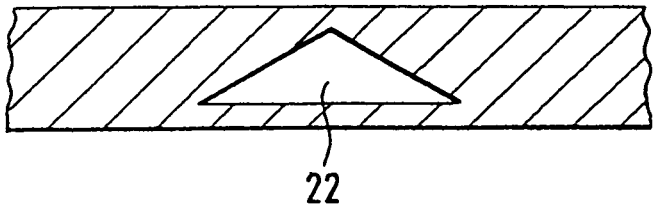
FIG. 8*b* shows the security element according to FIG. 8*a* in a top view in transmitted light.
Figure 8C:
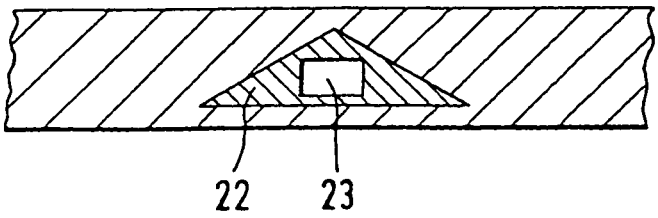
FIG. 8*c* shows the security element according to FIG. 8*a* in a top view in incident light.

Like in FIG. 6*a* in FIG. 8*a* is shown an embodiment, in which the gap 8 comes to lie above the gap 16 and covers a larger area than the latter. In contrast to the embodiment in FIG. 6*a*, FIG. 8 shows a variation wherein the optically denser layer 6 consists of aluminum and the optically thinner layer 7 of copper. The effect perceptible in transmitted light as shown in FIG. 8*b*, corresponds to that shown in FIG. 6*b*. I.e., the transparent surface 22, which the viewer is able to perceive, corresponds to the gap 8. In incident light, however, FIG. 8*c* shows another form of appearance than the one described in FIG. 6*c*. Gap 16 is recognizable as a transparent area 23 in the form of a rectangle, while the gap 16 can be perceived as a copper-coloured triangle 22. The rest of the surface of the security element appears silver-coloured which is due to the aluminum layer.

Figure 9A:
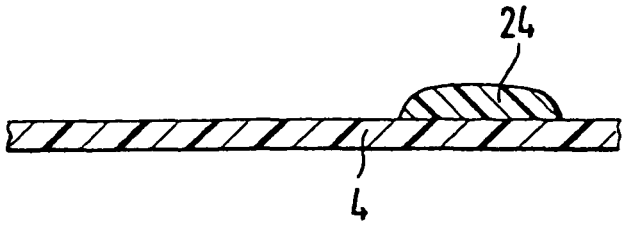
FIGS. 9*a* to 9*e* show a method for producing an inventive security element.
Figure 9B:
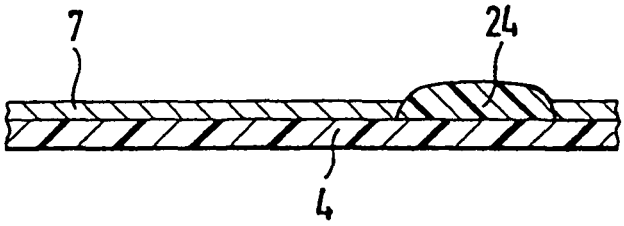

FIG. 9*a* to 9*e* schematically display the method for producing an inventive security element as shown in FIGS. 5*a* and 7*a*. The method is explained by way of example for security threads or security labels, but, of course, can be used analogously for security elements with different layer sequences. The security elements preferably are produced in the form of a security foil, which contains a number of simultaneous copies of the security element. In the displayed example a self-supporting plastic film 4 forms the basis. In a first stage, as shown in FIG. 9*a*, this film is printed with a strongly pigmented printing ink 24 in the areas where later the gaps 16, 8 shall be present, so that a large-pored print is the result. Afterwards, the in this case optically thinner metal layer 7 made of aluminum is applied to the printed plastic film 4. This is preferably effected by a vapor deposition method, with the help of which the metals are vapor-deposited one after the other, optionally via masks, onto the plastic film 4. In the area of the print 24 the formation of a continuous metal layer does not take place, which is due to the porous surface structure of the printing ink. The intermediate product provided with the metal layer 7 is displayed in FIG. 9*b*.

Figure 9C:
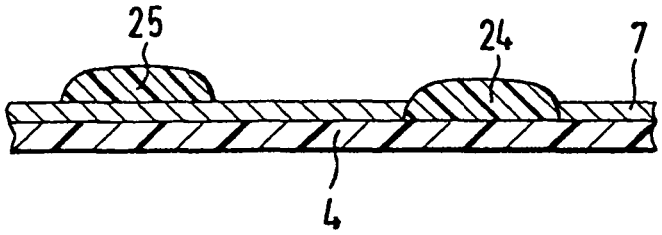

With the first print of washable ink will be manufactured the gap 16 in the embodiment shown in FIGS. 5*a* and 7*a*. As to manufacture the gaps 8, again a print 25 with washable ink is effected on the desired place. FIG. 9*c* here shows the intermediate product printed with the printing ink 24 and afterwards coated with aluminum and again printed with ink 25.

Figure 9D:
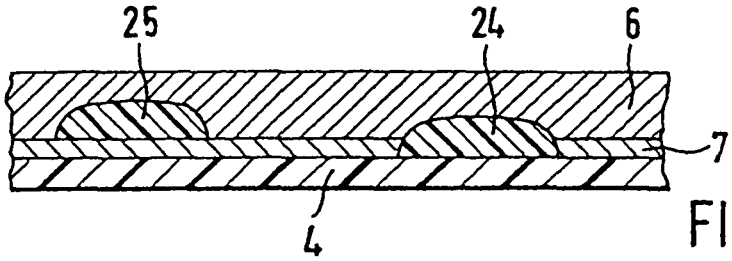

This intermediate product then again is coated with metal, e.g. with aluminum, so as to manufacture the optically denser layer 6 (see FIG. 9*d*).

Figure 9E:
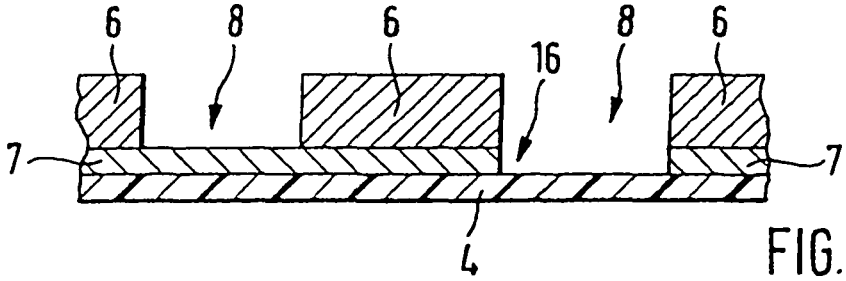

Since a formation of a solid metal surface does not take place in the area of the print 24 and 25, the print and the metal layer 6 or 6 and 7 present in this area can be removed nearly without difficulty by washing out. Preferably, water is used for the washing out. Possibly, it may become necessary to additionally use brushes, which ensure a complete removal of the print 24 and 25. The final product is shown in FIG. 9*e*. The metal layers 6 and 7 have the gaps 8 and 16. Afterwards the security foil can be cut into security elements of the desired form.

The washing method has the advantage that sharp and defined edges and contours are achieved, so that with the help of this method also very fine high-resolution characters or patterns can be manufactured in the metal layers.

FIG. 10*a* to 13 show further variations of the inventive security element, gaps being combined to form positive text or negative text and may be being present in one or both layers.

Figure 10A:
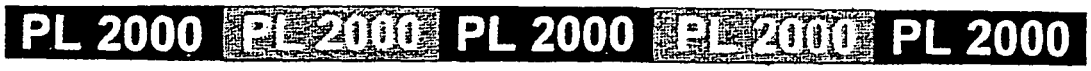
FIG. 10*a* shows further variations of the inventive security element in a top view in transmitted light.
Figure 10B:
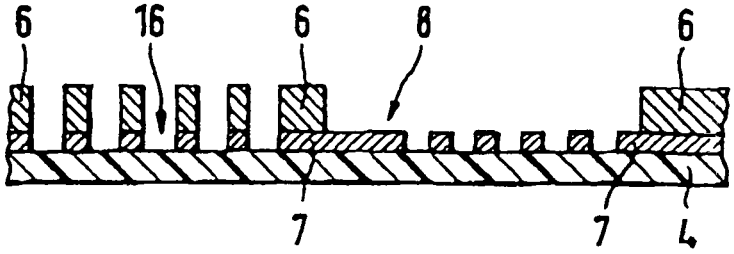
FIG. 10*b* shows further variations of the inventive security element in a top in cross section, FIG. 11 a shows further variations of the inventive security element in a top view in transmitted light, FIG. 11 b shows further variations of the inventive security element in a top view in cross section.

FIG. 10*a* shows an embodiment, in which on the one hand the gaps 16 come to lie in the optically thinner layer 7 congruently to the gaps 8 in the optically denser layer 6, and on the other hand the gap 8 in the optically denser layer is substantially larger than the gaps 16. By this explicit disposition of the gaps in transmitted light to the viewer the writing "PL 2000" always appears as transparent area, which is disposed in an opaque field or in a semitransparent field. In FIG. 10*b* the layer structure of the security element shown in FIG. 10*a* can be seen in cross section. The representation of the cross section here is restricted to the representation of the two left fields shown in FIG. 10*a*.

Figure 11A:
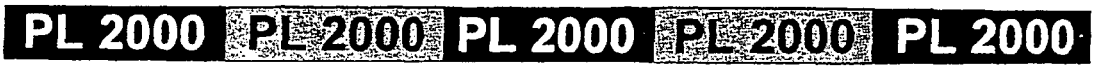

In FIG. 11*a* is shown an embodiment, in one area of which the gaps in the optically denser and the optically thinner layer come to lie congruently and in a further area the optically thinner layer is present all-over, while the gaps in the optically denser layer are designed in such a way that the writing "PL 2000" stands out as positive text against a semitransparent background. The pertinent layer structure is displayed in FIG. 11*b*, wherein again the two left fields of the security element shown in FIG. 11*a* are displayed.

Figure 12A:
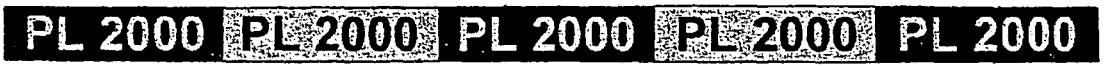
FIG. 12*a* shows further variations of the inventive security element in a top view in transmitted light.
Figure 12B:
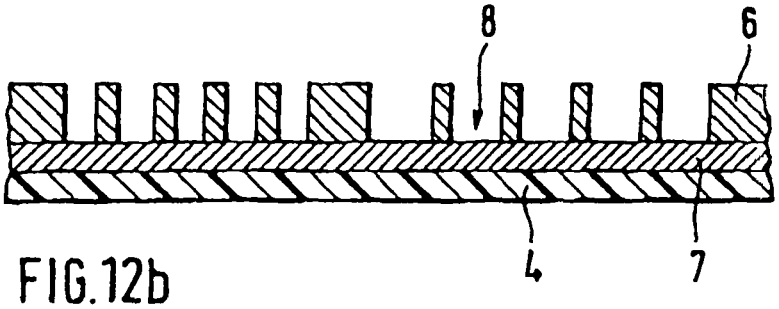
FIG. 12*b* shows further variations of the inventive security element in a top view in cross section.

In FIG. 12*a* is displayed a security element, that has areas, in which the semitransparent writing "PL 2000" appears in opaque surroundings, while in other fields the opaque positive writing "PL 2000" appears in semitransparent surroundings. This appearance is achieved by the fact, that the optically thinner layer 7 is present all-over and the optically thicker layer 6 applied thereon with the desired gaps is applied with the aim of manufacturing a positive or negative text. FIG. 12*b* shows the pertinent layer structure of the two left fields shown in FIG. 12*a*.

Figure 13:
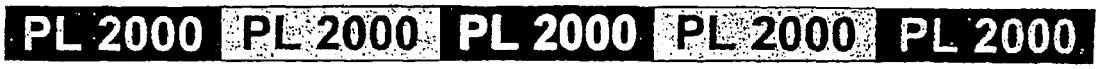
FIG. 13 shows further variations of the inventive security element in a top view in transmitted light and in cross section.
Figure 11B:
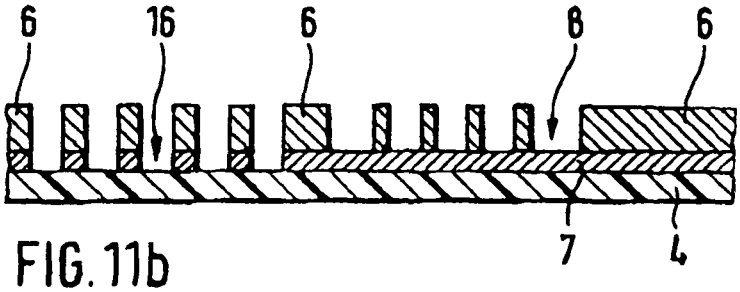

In FIG. 13 various gap variations shown in the previous Figures are combined with each other. In this security element a semitransparently appearing negative writing "PL 2000" is present in opaque surroundings, neighboured by a semitransparent field, in which appears the opaquely appearing positive writing "PL 2000" which in turn is neighboured by an opaquely appearing field with the transparently appearing writing "PL 2000". The layer structure of these three fields corresponds to the layer structure shown in FIG. 12*b* combined with the layer structure of the first field, which is shown in FIG. 11*b*.

The invention claimed is:

1. Security element for security papers, bank notes, or ID cards, said security element comprising:

a substrate; and at least two metal layers disposed on said substrate, wherein said at least two metal layers comprise an optically dense layer having gaps, and an optically less dense layer, wherein said at least two metal layers constitute the same material; wherein the at least two metal layers are disposed on the same side of the substrate and wherein the optically less dense layer is present all-over.

2. Security element according to claim 1, wherein the metal layers lie directly one above the other.

3. Security element according to claim 1, wherein the optically thinner layer of the at least two metal layers is present at least in those areas on the substrate, in which the optically denser layer is not present.

4. Security element according to claim 1, wherein the gaps are present in the form of alphanumeric characters, patterns, logos or the like or in the form of a bar code.

5. Security element according to claim 1, wherein the optically denser layer has a maximum transmission of 30%.

6. Security element according to claim 1, wherein the maximum transmission of the optically denser metal layer amounts to 10% and the minimum transmission of the optically thinner metal layer amounts to 50%.

7. Security element according to claim 1, wherein the metal used in the at least two metal layers can be aluminum, silver, copper, gold, chromium, platinum, palladium, titanium, Inconel, silver bronze, gold bronze or an alloy made of at least two of the aforementioned metals.

8. Security element according to claim 1, wherein the at least two metal layers have different layer thicknesses.

9. Security element according to claim 1, wherein one metal layer is designed opaque and one metal layer semitransparent.

10. Security element according to claim 1, wherein a part of the gaps in the at least two metal layers is present in a congruent fashion.

11. Security element according to claim 1, wherein the layer thickness of the optically denser layer amounts to between 20 and 300 nm and the layer thickness of the optically thinner layer amounts to between 2 and 20 nm.

12. Security element according to claim 1, wherein the substrate is a plastic layer.

13. Security element according to claim 1, wherein the substrate has a diffraction structure in the form of a relief structure.

14. Security element according to claim 1, wherein the substrate is a self-supporting plastic film.

15. Security element according to claim 1, wherein the substrate is disposed on a carrier material.

16. Security element according to claim 1, wherein the security element is a transfer element.

17. Security element according to claim 1, wherein the security element is a self-supporting label.

18. Security element according to claim 1, wherein the security element has round, oval, star-shaped, rectangular, trapezoidal or strip-shaped outline contours.

19. Security element according to claim 1, wherein the security element is a security thread.

20. Security element according to claim 1, wherein the security element is a laminated film.

21. Security paper for producing documents of value, characterized in that it has at least one security element according to claim 1.

22. Security paper according to claim 21, wherein the security element is a security thread, which is at least partially embedded in the security paper.

23. Security paper according to claim 21, wherein the security paper has a continuous opening and the security element is disposed in the area of the opening and protrudes it on all sides.

24. Security paper according to claim 21, wherein the security element is a transfer element or a laminated film, which is applied onto the surface of the security paper.

25. Security paper according to claim 21, wherein the security element has round, oval, star-shaped, rectangular, trapezoidal or strip-shaped outline contours.

26. Security element as recited by claim 1, wherein said optically less dense layer is structured such that the gaps are no longer recognizable as such when viewed in incident light.

27. Document of value, characterized in that it has at least one security element according to claim 1.

28. The document of value of claim 27, wherein said document of value is a bank note or ID card.

29. Transfer material or laminated film for producing security elements, said transfer material or laminated film comprising:

a carrier foil;

a substrate; and at least two metal layers disposed on said substrate, wherein said at least two metal layers comprise an optically dense layer having gaps, and an optically less dense layer structured such that the gaps are no longer recognizable as such when viewed in incident light, wherein the metal layers constitute the same material wherein the at least two metal layers are disposed on the same side of the substrate and wherein the optically less dense layer is present all-over.

30. Transfer material or laminated film according to claim 29, wherein the metal layers lie directly one above the other.

31. Transfer material or laminated film according to claim 29, wherein the optically thinner layer of the at least two metal layers is present at least in those areas on the substrate, in which the optically denser layer is not present.

32. Transfer material or laminated film according to claim 29, wherein at least the optically denser layer of the at least two metal layers has gaps.

33. Transfer material or laminated film according to claim 29, wherein the substrate is a plastic layer.

34. Transfer material or laminated film according to claim 29, characterized in that the substrate has a diffraction structure in the form of a relief structure.

35. Transfer material or laminated film according to claim 29, wherein the metal used in the at least two metal layers can be aluminum, silver, copper, gold, chromium, platinum, palladium, titanium, Inconel, silver bronze, gold bronze or an alloy made of at least two of the aforementioned metals.

* * * * *